US007518517B2

(12) United States Patent
Sako et al.

(10) Patent No.: US 7,518,517 B2
(45) **Date of Patent: *Apr. 14, 2009**

(54) VERIFICATION METHOD OF GOODS USING IC TAGS AND EQUIPMENT USING THE METHOD

(75) Inventors: Hiroshi Sako, Shiki (JP); Tatsuhiko Kagehiro, Kokubunji (JP); Hiroto Nagayoshi, Kokubunji (JP); Satomi Baba, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 61 days.

This patent is subject to a terminal disclaimer.

(21) Appl. No.: 11/723,588

(22) Filed: Mar. 21, 2007

(65) Prior Publication Data

US 2007/0273512 A1 Nov. 29, 2007

Related U.S. Application Data

(63) Continuation of application No. 11/032,071, filed on Jan. 11, 2005, now Pat. No. 7,199,714.

(30) Foreign Application Priority Data

Oct. 13, 2004 (JP) ..... 2004-298334

(51) Int. Cl.
*G08B 13/14* (2006.01)

(52) U.S. Cl. ..... 340/572.1; 283/83

(58) Field of Classification Search ..... 340/572.1, 340/572.5, 572.8, 572.9; 283/82, 83
See application file for complete search history.

(56) References Cited

U.S. PATENT DOCUMENTS 6,255,948 B1 7/2001 Wolpert et al.
6,471,878 B1 10/2002 Greene et al.
6,891,474 B1 5/2005 Fletcher
7,116,222 B2 10/2006 Sills et al.
7,199,714 B2 * 4/2007 Sako et al. ..... 340/572.1

FOREIGN PATENT DOCUMENTS

| | | |
|---|---|---|
| DE | 101 63 267 A1 | 7/2003 |
| EP | 0 019 191 A1 | 11/1980 |
| EP | 1 139 302 A1 | 10/2001 |
| EP | 1 367 547 A2 | 12/2003 |
| JP | 2001-283011 | 10/2001 |
| JP | 2003-058856 | 2/2003 |
| WO | WO 03/054808 | 7/2003 |

* cited by examiner

*Primary Examiner*—John A Tweel, Jr.
(74) *Attorney, Agent, or Firm*—Antonelli, Terry, Stout & Kraus, LLP.

(57) ABSTRACT

A goods genuineness/counterfeit discrimination method using a plurality of IC tags each having functions of storing genuineness/counterfeit discrimination information and transmitting the genuineness/counterfeit discrimination information and a genuineness/counterfeit discrimination equipment for receiving the genuineness/counterfeit discrimination information from the IC tags to use it for genuineness/counterfeit discrimination, the method including: reading, by means of the genuineness/counterfeit discrimination equipment, information stored in one or more IC tags mounted on goods on which a first predetermined number of IC tags are mounted; and discriminating genuineness/counterfeit of the goods by determining, by means of the genuineness/counterfeit discrimination equipment, whether or not partial information is identical to each other among genuineness/counterfeit discrimination information read from IC tags equal to or more than a second predetermined number of IC tags mounted on the goods, the second predetermined number being smaller than the first predetermined number.

17 Claims, 5 Drawing Sheets

VERIFICATION METHOD OF GOODS USING IC TAGS AND EQUIPMENT USING THE METHOD

CROSS REFERENCE TO RELATED APPLICATION

This is a continuation of U.S. application Ser. No. 11/032,071, filed Jan. 11, 2005 (now U.S. Pat. No. 7,199,714). This application relates to and claims priority from Japanese Patent Application No. 2004-298334, filed on Oct. 13, 2004. The entirety of the contents and subject matter of all of the above is incorporated herein by reference.

BACKGROUND OF THE INVENTION

The present invention relates to a method for verifying genuineness/counterfeit of goods by using IC tags mounted to the goods and an equipment using the method. The "IC tag" referred to herein generally terms a minute device having the function of transmitting information by radio and designates a semiconductor chip, μ chip, general RFID or the like.

In recent years, purchase of goods based on utilization of electronic money and credit cards has been prevailing actively and a decrease in the amount of banknotes in circulation is in prospect but oppositely, purchase of goods based on utilization of paper currency is still active at present. This can be demonstrated clearly by an increase in the issue amount of banknotes. On the other hand, the number of cases of illegal access to automatic teller machines as exemplified by the use of counterfeit banknotes has been increasing extremely nowadays. Accordingly, paper currency incorporating various kinds of security has been developed newly in every country. Also, from the standpoint of fakes, sophisticated forgeries of brand articles have been on the market as internationalization advances and countermeasures thereagainst have been of importance. Besides, a producer per se of a brand article sometimes makes a counterfeit from the same material as that of the brand article and for discrimination of the genuine article, it is necessary not to inspect the quality of the article per se but to check information as to whether the article is recognized by a legal maker.

Under the circumstances as above, mounting IC tags to a banknote or goods or an article added with an authentication function based on IC tags has recently been the most promising. This is the way to discriminate counterfeits from genuine goods by using information incorporated in an IC tag. For example, JP-A-2003-58856 entitled "Anticounterfeit Print Medium with Built in Microminiaturized IC Chip, and Anticounterfeit Printed Matter" proposes that a single or a plurality of semiconductor chips are embedded at a specified area in a paper-like goods. JP-A-2001-283011 entitled "Security Having Semiconductor Chip" proposes a method of grading up countermeasures against forging through disguised intention by preparing for negotiable securities having semiconductor chips a chip capable of sending information therein and another chip incapable of sending information therein.

SUMMARY OF THE INVENTION

The conventional methods described as above are very effective to perform goods genuineness/counterfeit discrimination, that is, to discriminate counterfeits from genuine goods. But it appears that these methods lack, to some extent, respecting the position of a person having an article to be subject to the goods genuineness/counterfeit discrimination. More specifically, the goods genuineness/counterfeit discrimination gives weight to discrimination based on information in an IC tag (semiconductor chip) and hence, in the event that the IC tag per se operates erroneously, becomes faulty or separates from an object member, a counterfeit is determined even if the object member is genuine. Especially, securities and banknotes will be circulated for several years to several of tens of years with high possibility and conceivably, the quality of the IC tag per se can hardly be guaranteed in some case.

In order to solve the above problems, according to this invention, a plurality of IC tags (being A in number) each holding information indicative of the fact that these IC tags are mounted on the same object member are carried on a single goods. In performing goods genuineness/counterfeit discrimination, a ratio $\alpha$ of a number B of IC tags which have sent the information indicative of their mounting on the same object member to a number A of IC tags from which the information is to be sent originally is determined and the genuineness/counterfeit discrimination is carried out with the ratio $\alpha$. Namely, when $B>C=[\alpha*A]$ is held where [ ] represents Gauss' notation and $\alpha>=0.5$ stands, the goods is determined to be genuine. Further, in case the genuineness/counterfeit discrimination is desired to be further promoted when, for example, B is smaller than A and approximates C, another type of genuineness/counterfeit discrimination using another means may be used in combination in accordance with a value of the number B. In addition, for genuineness/counterfeit discrimination of plural kinds of articles, any two per se of the three kinds of information A, C and $\alpha$ incorporated in the mounted IC tags may be stored in the IC tags and discrimination may be carried out in accordance with differences in kinds of articles by calling out and using the stored information for the purpose of discrimination. Alternatively, a method may be employed in which all of the three kinds of information A, C and $\alpha$ are set to fixed values in advance or part of them are set to fixed values and the remaining values are read out of the IC tag. When the genuineness/counterfeit discrimination employing the different means is used in combination, information capable of being detected by the means is added to a goods.

For example, when $\alpha$ is set to a value greater than 0.5, B is greater than or equal to 6 (exclusive 5) in case of A being 10. Accordingly, IC tags which are smaller than 4, inclusive of 4, in number can be permitted for fault and separation. This can ensure that the number of erroneous discrimination operations which determine a genuine goods as a counterfeit one owing to fault or separation of an IC tag can be decreased considerably. Besides, even when an IC tag or tags are removed intentionally and mounted on a counterfeit so as to enable it to personate a genuine one, there results in a shortage of the number of IC tags and a counterpart of one object article cannot be made. Further, in case of an automated teller machine handling banknotes, even when B>C stands upon receiving of money, the machine can function to collect a banknote in accordance with the magnitude (small or large) of B, that is, the number of IC tags considered to be faulty. Through this, concurrently with completion of receiving of money, a banknote being genuine but having its IC tag or tags troubled or separated can be collected and improvements in reliability of paper currency can be expected.

Advantageously, according to the present invention, a plurality of IC tags are mounted in advance to a goods required to be subject to genuineness/counterfeit discrimination, such as a banknote or security, and during discrimination, a ratio $\alpha$ of a number B of IC tags having sent information indicative of their mounting on the same object member to a number A of IC tags from which the information is to be sent originally is determined and the genuineness/counterfeit discrimination is carried out with the ratio α, whereby discrimination accuracy can be maintained while making the correspondence with a fault of IC tag.

Other objects, features and advantages of the invention will become apparent from the following description of the embodiments of the invention taken in conjunction with the accompanying drawings.

DESCRIPTION OF THE EMBODIMENTS

Embodiments of this invention will now be described in greater detail with reference to the accompanying drawings. An example of the banknote genuineness/counterfeit discrimination flow utilizing IC tags according to an embodiment of the invention will be described by making reference to FIG. 1. A banknote embedded with IC tags is exemplified in FIG. 2 and an automated teller machine having the genuineness/counterfeit discrimination function is constructed as schematically illustrated in FIG. 3.

Figure 2:
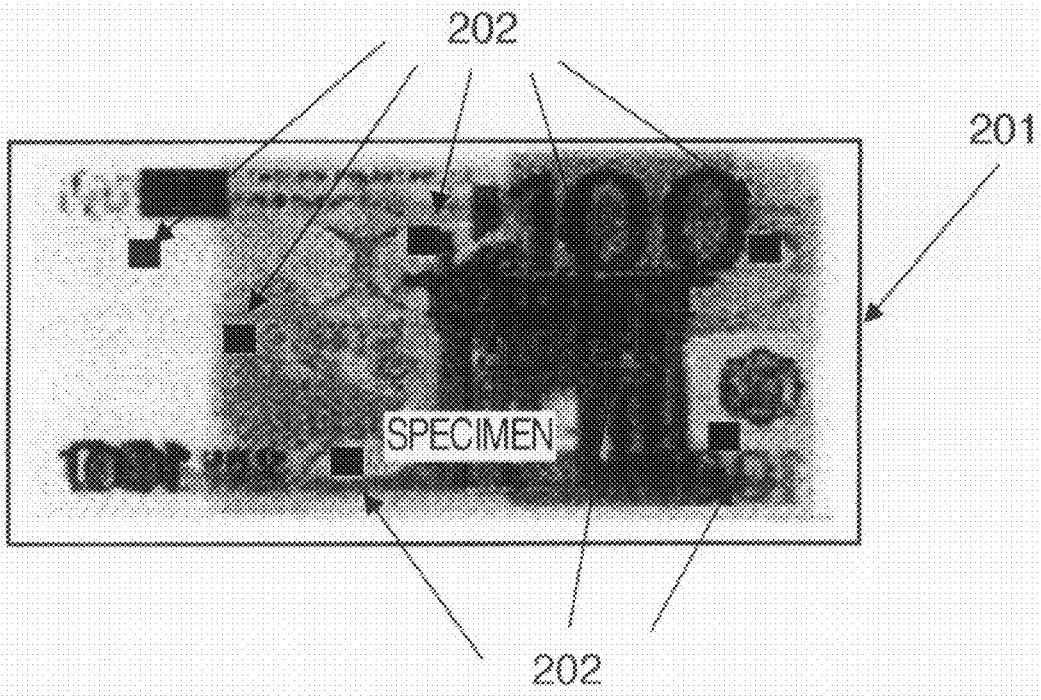
FIG. 2 is a diagram showing an example of a banknote embedded with IC tags.
Figure 3:
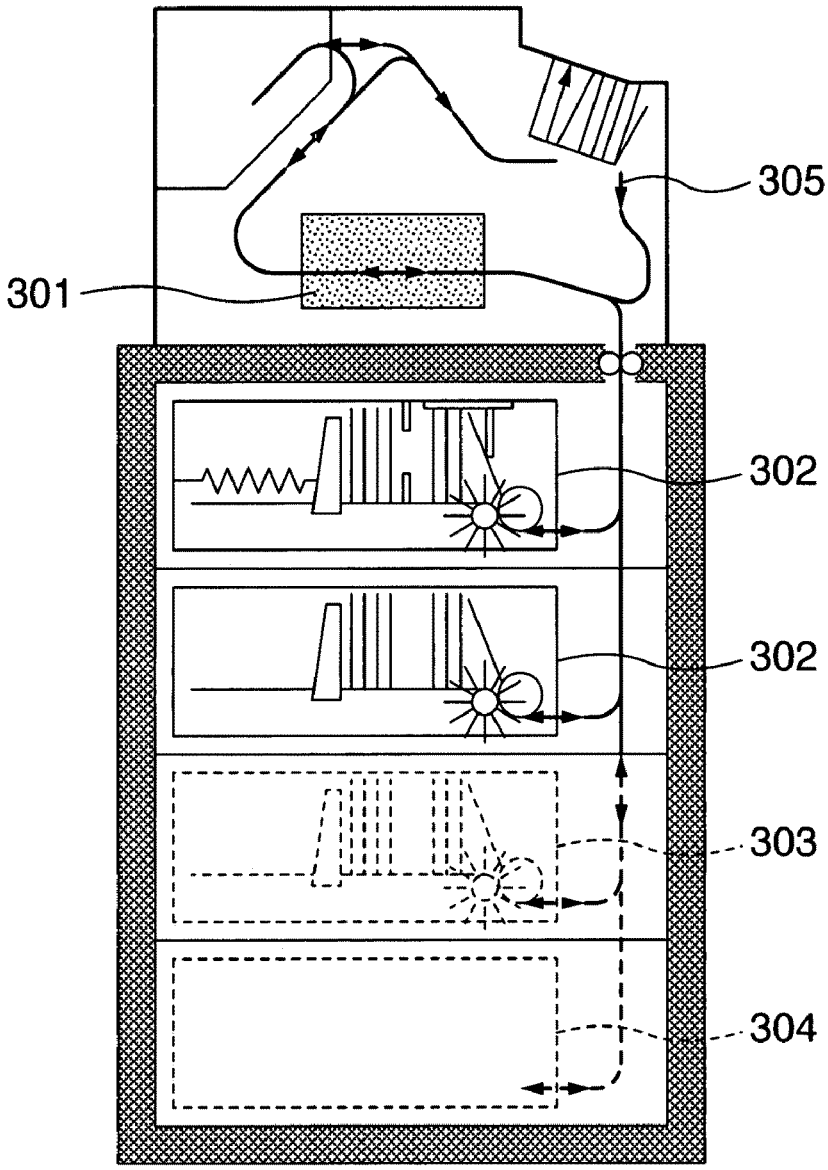
FIG. 3 is a schematic diagram showing the construction an automated teller machine having the genuineness/counterfeit discrimination function.

In the example shown in FIG. 2, seven IC tags 202 are braided in a banknote. (A=7) 201. Information in these IC tags is read by means of a validation unit 301 in FIG. 3 to perform banknote genuineness/counterfeit discrimination. The validation unit has a reader for the IC tags. To meet the genuineness/counterfeit discrimination, the validation unit 301 can also have another function to discriminate genuineness/counterfeit on the basis of a printed pattern. In accordance with information as a result of the genuineness/counterfeit discrimination, a banknote is collected into either of two upper stages of genuine banknote boxes 302 when the banknote is genuine, a banknote is collected to the lowermost stage of counterfeit banknote box 304 when the banknote is counterfeit and a banknote mounted with a permissible number of defective IC tags is collected into the lowermost but one stage of damaged banknote box 303. A feeding mechanism 305 for feeding banknotes feeds a banknote toward the validation unit 301 and then feeds it from the validation unit 301 towards the individual boxes. Which one of the boxes the feeding mechanism 305 feeds a banknote to is determined in accordance with the result of genuineness/counterfeit discrimination in the validation unit 301.

Figure 5:
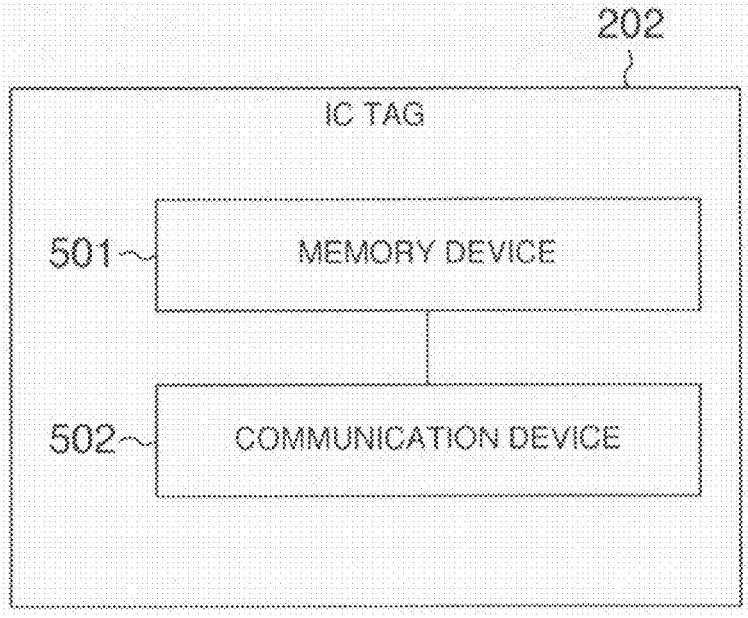
FIG. 5 is a diagram showing an example of construction of an IC tag.

Referring now to FIG. 5, an example of construction of an IC tag will be described. A memory device 501 stores genuineness/counterfeit discrimination information used for deciding that a plurality of IC tags are mutually carried on the same goods. A communication device 502 is adapted to send the genuineness/counterfeit discrimination information to the outside when genuineness/counterfeit discrimination is in progress. In case the memory device 501 is made from a read only memory medium capable of reading the genuineness/counterfeit discrimination information only once, personation can be prevented which is effected by rewriting the genuineness/counterfeit discrimination information of an IC tag removed from one article and mounting the thus rewritten IC tag to another article. Conceivably, as the genuineness/counterfeit discrimination information, totally or partly the same ID can be assigned to the IC tags carried on the same goods. As partly the same ID, a personal ID number allotted to the goods may be used. Alternatively, the genuineness/counterfeit discrimination information in the IC tags carried on the same goods may include a serial number. However, this is not limitative and another kind of information may be utilized as the genuineness/counterfeit discrimination information, provided that mounting of the IC tags on the same goods can be determined from that information to discriminate the IC tags from those carried on another goods. In order to prevent one IC tag from being counted plural times in step S2, the genuineness/counterfeit discrimination information may include partly different information by applying a serial number to IC tags mounted on one goods. Also, a combination (A, n) of the total number (A) of IC tags to be mounted on the same goods and information indicating which ordinal number (n) the respective IC tags have in the tag total number (A) may be included in the genuineness/counterfeit discrimination information.

Figure 6:
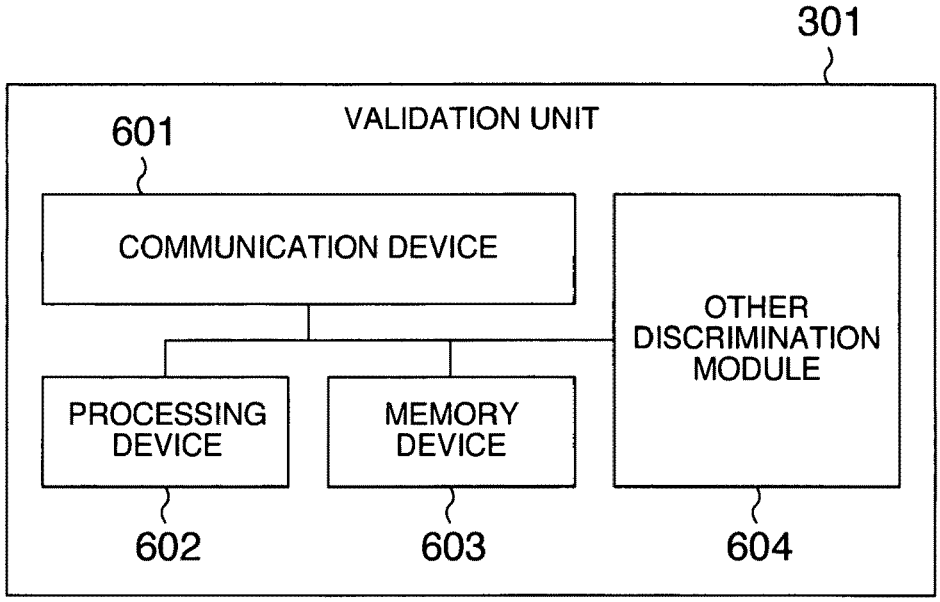
FIG. 6 is a diagram showing an example of construction a validation unit.

The validation unit 301 is constructed as shown in FIG. 6. A communication device 601 is used to communicate with the communication device 502 of IC tag so as to read genuineness/counterfeit discrimination information. A processing device 602 performs a genuineness/counterfeit discrimination process on the basis of the read genuineness/counterfeit discrimination information. A memory device 603 stores a program for the genuineness/counterfeit discrimination process and the read genuineness/counterfeit discrimination information. When at least any of the numerical values A, C and α used for genuineness/counterfeit discrimination are determined in advance as described previously, the information may be stored in the memory device 603. To meet the case where other information than that in the IC tag is used in combination, a different discrimination adaptive module 604 may be provided. The different discrimination adaptive module may be equipped with an input means, for example, a scanner and an information processing for discrimination may be carried out with the processing device 602.

Figure 1:
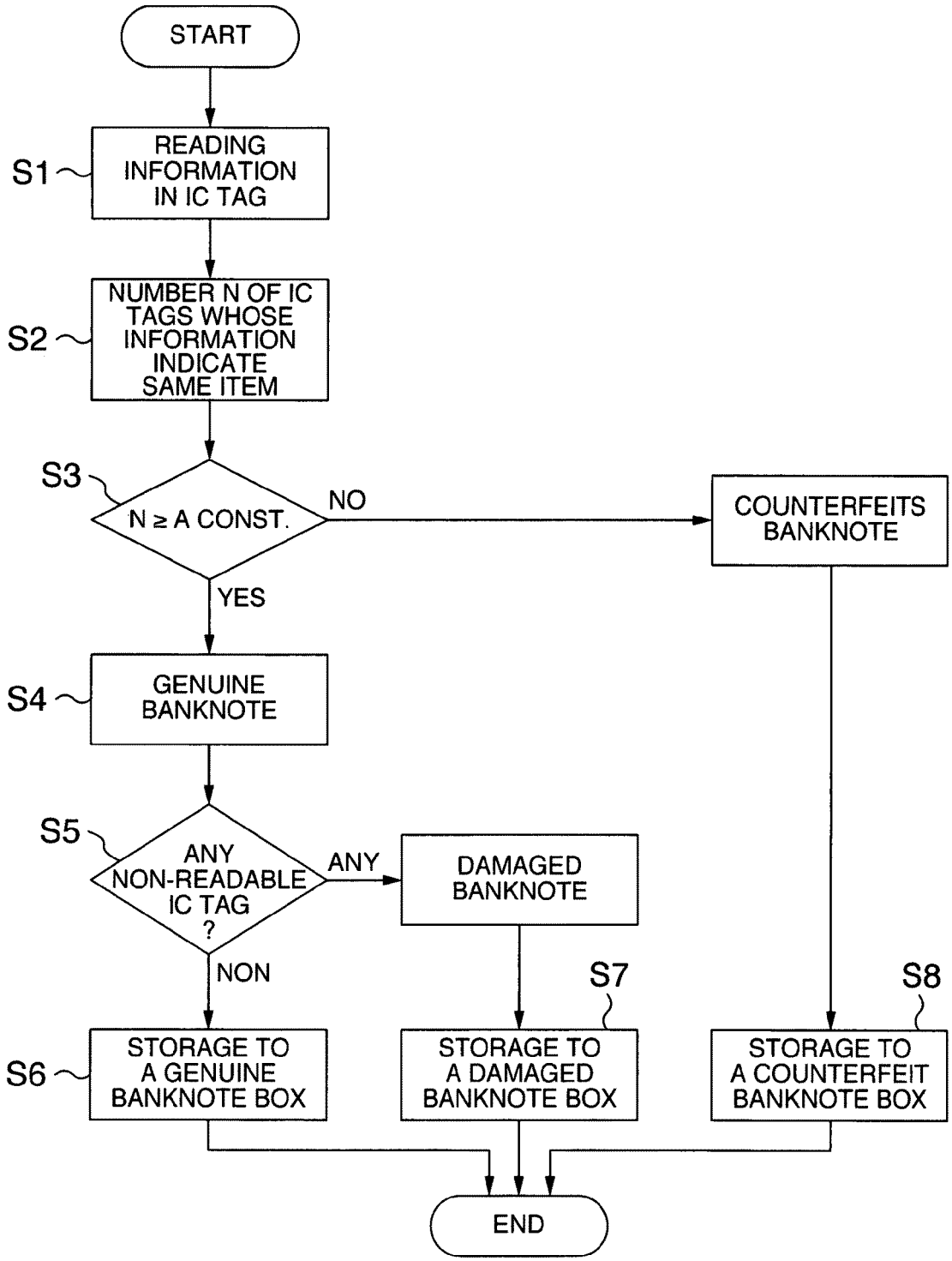
FIG. 1 is a flowchart showing an example of the banknote genuineness/counterfeit discrimination flow utilizing IC tags according to an embodiment of the invention.
Figure 4:
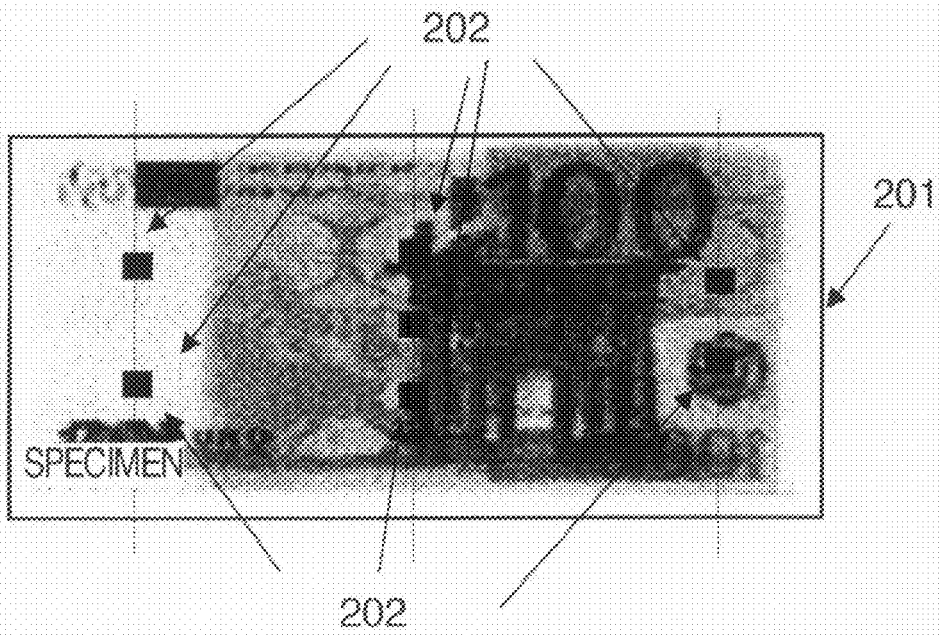
FIG. 4 is a diagram showing another example of a banknote embedded with IC tags.

An example of the flow of banknote genuineness/counterfeit discrimination carried out by the processing device of validation unit is depicted in FIG. 1. In step S1,information of each IC tag is read. If IC tags are disposed randomly in a banknote, many sensors for fetching the information must be arranged vertically to the banknote feeding direction in correspondence with the randomly positioned IC tags. This does not matter seriously but with a view to decreasing the number of sensors, IC tags to be carried on a banknote may be juxtaposed on lines extending in parallel to the note feeding direction as shown in FIG. 4. In this case, the information in the IC tags is read on time series. The information stored in the IC tag includes at least a banknote ID number distinctive of a different banknote. In addition to the above information, a tag ID number for distinguishing tags in the same banknote from each other and two of the three kinds of information A, C and may be stored in each IC tag. Further, as information for making the correspondence between IC tag and banknote per se, information of a pattern specific to a banknote, for example, a banknote number may be stored. Furthermore, check coordinates for checking a subsidiary banknote pattern may be stored.

In the step S2 in FIG. 1, the number of IC tags, from which the information indicative of the fact that the IC tags are carried on the same object member has been sent, is determined. To this end, genuineness/counterfeit discrimination information in each IC tag is read and the number of read-out pieces of genuineness/counterfeit discrimination information indicative of mounting of each IC tag on the same banknote is counted. In case the banknote is genuine, all pieces of genuineness/counterfeit discrimination information indicate mounting of the IC tags to the same banknote and consequently, a number B of the IC tags can be counted. On the other hand, in the event that there is a functionally faulty IC tag from which the information cannot be read or a forged IC tag from which the information cannot be read, that IC tag is by no means measured in number. In the presence of an IC tag removed from a different banknote by intention and mounted on the banknote in question, genuineness/counterfeit discrimination information corresponding to the different banknote is read. In such an event, pieces of genuineness/counterfeit discrimination information corresponding to plural banknotes exist and IC tags from which the information is read at larger frequency are counted in number. In an application to higher security level, information for making the correspondence between IC tag and banknote per se may be read and the read information may be compared with information obtained from a banknote pattern to determine a banknote ID number to be counted. For example, when the information for making the correspondence between IC tag and banknote per se is a mark number, this information is read out of the banknote pattern by utilizing the existing OCR technique, for instance, and is collated with the mark number information read out of the IC tag.

In step S3, the count value B is evaluated. More particularly, discrimination based on the previously-described $B>C=[\alpha*A]$ where [ ] represents Gauss' notation and $\alpha>=0.5$ stands is carried out. The value of C may be defined on the program or in consideration of generality, the value of C may be written in the IC tags in advance and may be read out of one of the IC tags which contributes to the count value B. If this inequality is not satisfied, the banknote is determined to be counterfeit and is stored in the counterfeit banknote box. With the banknote determined to be counterfeit, illegal receiving of money is settled and a process of giving the alarm, for example, is proceeded with in expectation of the possibility that the banknote is a forged one. If the inequality is satisfied, the banknote is determined to be genuine in step S4. In an application to higher security level, an additional check based on the magnitude of count value B may be done in the step S4. For example, when the value of B approximates C (the number of IC tags from which the information cannot be read is slightly larger), information for making the correspondence between IC tag and banknote per se, for example, a mark number is checked through the aforementioned OCR technique by using the different discrimination adaptive module 604. In this manner, a banknote, in which the number of IC tags from which the information cannot be read is slightly large indicating that the banknote is slightly degraded in reliability, can be checked additionally pursuant to a more stringent criterion, thereby complementing the reliability of the IC tags. Further, check coordinates for checking a subsidiary banknote pattern can be read out of one of the IC tags which contribute to the count value B and a physical quantity at that area can be inspected. By making $\alpha$ greater than 0.5, it is possible to invalidate a forging method in which half of the IC tags originally carried on one article are removed and then carried on a counterfeit article to enable it to personate a genuine article.

In step S5, it is decided, in accordance with the magnitude of a value of (A−B), whether the genuine banknote is to be circulated or collected. The value of A may be defined on the program or in consideration of generality, it may be read out of one of the IC tags which contribute to the count value B. When the value of (A−B) is larger than a constant value, it is indicated that faulty IC tags exist by a number larger than a constant number and the banknote is determined to be faulty and fed to the damaged banknote box. Through this mechanism, an aged banknote (having a large number of defectively operating IC tags) can be kept off from circulation so as to be collected. The banknote to be fed to the damaged banknote box is, however, determined to be genuine in the step S4 and is therefore handled as correctly received money. On the other hand, when the value of (A−B) is smaller than the constant value, the banknote is determined to be circulative now and in the future and is stored in the genuine banknote box. If the automated teller machine is of the reflux type, the banknote stored in the genuine banknote box 302 is used for payment but the banknote stored in the damaged banknote box 303 is not used for payment.

Conceivably, if being necessary for future analysis, the count value B, the information in each IC tag (banknote ID number, tag ID number and so on) and information about a user having thrown the banknote may be stored while relating them to each other in respect of each discriminated banknote.

The present invention is in no way limited to the object described in the foregoing embodiments but can be applied more widely. For example, this invention is not restricted to the banknote but can be applied to securities, credit vouchers and good luck lotteries whose values are to be guaranteed for a constant period. In addition thereto, this invention can be utilized for genuineness/counterfeit discrimination of products whose value must be guaranteed, especially, whose imitations are on the market by a great number, such as so-called brand articles.

Figure 7:
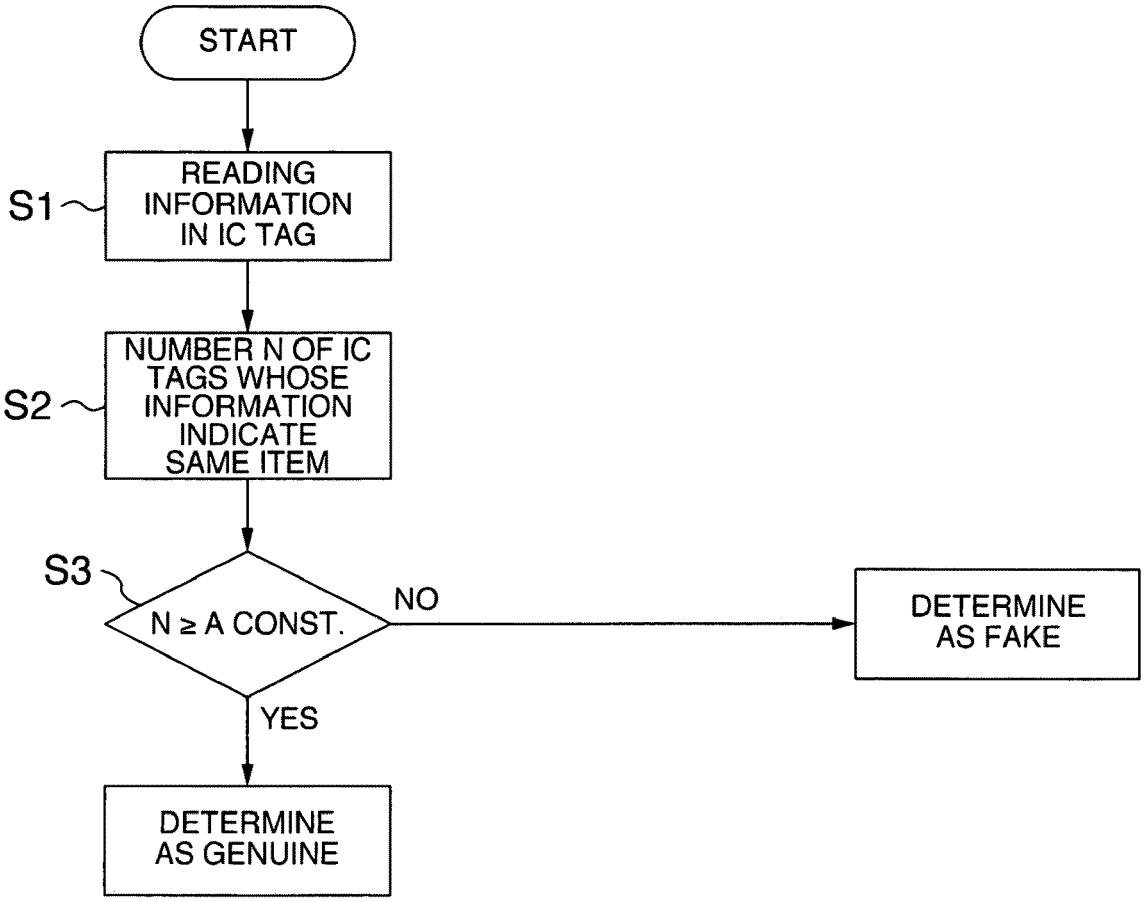
FIG. 7 is a second example of the genuineness/counterfeit discrimination flow.

When the banknote genuineness/counterfeit discrimination is carried out by using other apparatus than the automated teller machine or when the genuineness/counterfeit discrimination as applied to other articles than banknote is carried out, it suffices that steps up to the step S3 described in connection with FIG. 1 are executed (FIG. 7). In case of banknote, even a banknote determined to be genuine must be collected depending on the state of the banknote but in case of an article not required to be collected, the step S5 and ensuing steps can be omitted. In apparatus for this purpose, the provision of the validation unit shown in FIG. 6 for reading IC tags to perform the genuineness/counterfeit discrimination process suffices and the apparatus can be materialized with such a compact device as a hand-held bar-code reader.

As has been described previously, the present invention can completely solve the conventional contradictory problems of restricted lifetime and reliability of IC tags and guarantee of discrimination accuracy by the genuineness/counterfeit discrimination utilizing the IC tags and can be applied to genuineness/counterfeit discrimination of various kinds of articles whose value must be guaranteed for a constant period.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A goods genuineness/counterfeit discrimination method using a plurality of IC tags, each IC tag having functions of storing genuineness/counterfeit discrimination information and transmitting said genuineness/counterfeit discrimination information and a genuineness/counterfeit discrimination equipment for receiving said genuineness/counterfeit discrimination information from said IC tags to use it for genuineness/counterfeit discrimination, said method comprising:

reading, by means of said genuineness/counterfeit discrimination equipment, information stored in one or more IC tags mounted on goods on which a first predetermined number of IC tags are mounted; and discriminating genuineness/counterfeit of said goods by determining, by means of said genuineness/counterfeit discrimination equipment, whether or not partial information is identical to each other among genuineness/counterfeit discrimination information read from IC tags equal to or more than a second predetermined number of IC tags mounted on said goods, said second predetermined number being smaller than said first predetermined number.

2. A goods genuineness/counterfeit discrimination method according to claim 1, wherein said second predetermined number is equal to or greater than half of said first predetermined number.

3. A goods genuineness/counterfeit discrimination method according to claim 1, wherein said genuineness/counterfeit discrimination information includes information of said first predetermined number or information of said second predetermined number.

4. A goods genuineness/counterfeit discrimination method according to claim 1, comprising:

executing an additional measuring method in which the number or quality of portions adapted for measurement of a physical feature of the goods can be adjusted in accordance with a magnitude of the number of IC tags from which the genuineness/counterfeit discrimination information indicative of mounting of the IC tags on the same goods can be read.

5. A goods genuineness/counterfeit discrimination method according to claim 1, comprising:

collecting, even when said goods is determined to be genuine, said goods if mounted with IC tags from which the information cannot be read and the number of which is greater than a constant value.

6. A goods genuineness/counterfeit discrimination method according to claim 1, wherein partial information of said genuineness/counterfeit discrimination information is a same ID number.

7. A goods genuineness/counterfeit discrimination method according to claim 6, wherein said genuineness/counterfeit discrimination information comprise same information between a plurality of IC tags and different information between a plurality of IC tags.

8. A goods genuineness/counterfeit discrimination equipment for discriminating genuineness/counterfeit of goods mounted with IC tags, comprising:

a communication device for reading genuineness/counterfeit discrimination information in a plurality of IC tags mounted on the goods; and a processing device for reading a number of said IC tags and discriminating whether or not partial information of said genuineness/counterfeit discrimination information read from said IC tags are identical to each other, said number of said IC tags is equal to or more than a second predetermined number lower than a first predetermined number.

9. A goods genuineness/counterfeit discrimination equipment according to claim 8, wherein said second predetermined number is greater than half of said first predetermined number.

10. A goods genuineness/counterfeit discrimination equipment according to claim 8, wherein said genuineness/counterfeit discrimination information include information of said first predetermined number or information of said second predetermined number.

11. A goods genuineness/counterfeit discrimination equipment according to claim 8, comprising means for executing an additional measuring method in which the number or quality of portions adapted for measurement of a physical feature of the goods can be adjusted in accordance with a magnitude of the number of IC tags from which the genuineness/counterfeit discrimination information indicative of mounting of the IC tags to the same goods can be read.

12. A goods genuineness/counterfeit discrimination equipment according to claim 8, comprising means for collecting, even when said goods is determined to be genuine, said goods if mounted with IC tags from which the information cannot be read and the number of which is greater than a constant value.

13. A goods genuineness/counterfeit discrimination equipment according to claim 8, wherein the goods on which said IC tags are mounted is a banknote and said goods genuineness/counterfeit discrimination equipment has a function of automatically telling banknotes.

14. A goods genuineness/counterfeit discrimination equipment according to claim 13, comprising:

a counterfeit banknote box for storing, when the banknote is determined to be counterfeit, said counterfeit banknote;

a damaged banknote box for collecting said banknote, when the banknote is determined to be genuine and has IC tags the number of which is greater than a constant number and from which the information cannot be read; and a genuine banknote box for storing other types of banknote.

15. A goods genuineness/counterfeit discrimination equipment according to claim 13, wherein said equipment executes an additional measuring method in which the number or quality of portions adapted for measurement of a physical feature of the goods can be adjusted in accordance with a magnitude of the number of IC tags from which the genuineness/counterfeit discrimination information indicative of mounting of the IC tags to the same goods can be read.

16. A goods genuineness/counterfeit discrimination equipment according to claim 8, wherein partial information of said genuineness/counterfeit discrimination information is a same ID number.

17. A goods genuineness/counterfeit discrimination equipment according to claim 8, wherein said genuineness/counterfeit discrimination information comprise same information between a plurality of IC tags and different information between a plurality of IC tags.

* * * * *